United States Patent [19]

Gabrail

[11] 3,960,741

[45] June 1, 1976

[54] ETCHANT FOR REMOVING METALS FROM GLASS SUBSTRATES

[75] Inventor: Sami I. Gabrail, Syracuse, N.Y.

[73] Assignee: General Electric Company, Syracuse, N.Y.

[22] Filed: Aug. 28, 1974

[21] Appl. No.: 501,161

[52] U.S. Cl. ..... 252/79.3; 156/7; 156/18; 252/79.4

[51] Int. Cl.[2] ..... C09K 13/08

[58] Field of Search ..... 156/7, 18; 252/79.3, 252/79.4; 134/3, 41

[56] References Cited

UNITED STATES PATENTS

| | | | |
|---|---|---|---|
| 3,556,883 | 1/1971 | Naito et al. | 252/79.4 |
| 3,736,197 | 5/1973 | Messerschmidt et al. | 252/79.4 |
| 3,749,618 | 7/1973 | Fannin et al. | 252/79.3 |
| 3,767,491 | 10/1973 | Chough | 252/79.4 |
| 3,813,311 | 5/1974 | Beck et al. | 252/79.3 |

*Primary Examiner*—William A. Powell
*Assistant Examiner*—Jerome W. Massie
*Attorney, Agent, or Firm*—R. J. Mooney; D. E. Stoner

[57] ABSTRACT

Disclosed is an etchant for removing a metal, such as titanium, from a glass substrate without adversely attacking the glass. The etchant includes a relatively viscous coating agent that wets and coats and thus protects the glass but does not wet the metal thus permitting etching thereof. A nonionizing diluent can be included in the etchant to inhibit the etching rate if it is felt that the heat and turbulence that would otherwise be generated may be excessive and interfere with the action of the coating agent.

4 Claims, 2 Drawing Figures

ETCHANT FOR REMOVING METALS FROM GLASS SUBSTRATES

BACKGROUND OF THE INVENTION

This invention relates to etchants used in manufacturing processes and, more particularly, to etchants for removing metal from glass substrates without attacking the glass.

In the manufacture semiconductor devices, several etching steps are generally performed. Consequently, various types of etching operations are well developed arts in the semiconductor manufacturing industry. However, with the current growth of optoelectronic products, such as photoncouplers and optically coupled solid-state relays, new etching problems are facing semiconductor design and process engineers. Specifically, glass substrates are frequently used to support optoelectronic components. In conjunction with the step of mounting a semiconductive device pellet on the glass, metallic conductive paths are usually applied to the glass to provide coupling to the pellet. Typically the conductive paths are formed by coating the glass with metal and etching unwanted portions of the metal from the glass. When manufacturing optically coupled devices, a constraint new to the semiconductor device designer must be considered. Specifically, the glass must not be attacked in such a way as to become pitted or hazy or otherwise lose its transparency. Heretofore, no entirely satisfactory process was available.

It is now felt that a primary reason for the unavailability of satisfactory etchants is that those etchants that are commonly used are of the oxidation-reduction type in which an oxidizing agent causes oxidation of the material to be etched and a reducing agent destroys and removes the oxide. Further, the commonly used reducing agents, such as hydrofluoric acid, also attack the glass. Thus, whenever the glass is exposed, it is attacked. The overall etching process of the prior art cannot be controlled well enough to assure absolute uniformity of etching. Therefore, the metal is removed from some areas more rapidly than from other areas. The glass under the first exposed areas is attacked while the remaining etching is completed. This effect is compounded by the need to be absolutely certain that etching is complete over all areas of the surface inasmuch as if etching were prematurely terminated and a thin film of metal remained on the glass, short or leaky circuits among the conductors could occur and optical efficiency could be impaired.

An object of this invention, therefore, is to provide an etchant that effectively and completely removes selected metals from glass without attacking glass.

SUMMARY OF THE INVENTION

This invention is characterized by an etchant for removing selected metals from a glass substrate without adversely attacking the glass. Oxidizing and reducing agents are included in the etchant to remove the metal by an oxidation-reduction process. Also included in the etchant is a protective liquid coating agent that wets the glass substrate but not the metal or metal oxide. Consequently, the coating agent protectively coats the glass and prevents any significant attack thereof but does not protect the metal or metal oxide.

A feature of the invention is the inclusion of a substantially nonionizing diluent in the etchant to dilute the oxidizing and reducing agents and thus inhibit the rate of etching. This is advantageous inasmuch as rapid etching could create turbulence and heat sufficient to impair the protective operation of the coating agent. Consequently, the diluent enhances the uniformity of the protection provided the glass. A strongly ionizing diluent, such as water, would hasten etching action. The only water in the solution is the water necessary to hold the acids (such as nitric and hydrofluoric) in solution.

Another feature of the invention is the utilization of a coating agent that is relatively viscous. The viscosity of the coating agent prevents its displacement during the etching process. Thus, its protective effect is enhanced.

DESCRIPTION OF THE DRAWINGS

These and other features and objects of the present invention will become more apparent upon a perusal of the following description taken in conjunction with the accompanying drawings wherein.

DESCRIPTION OF THE PREFERRED EMBODIMENT

Prior to proceeding with a detailed description of the etchant and its use, it is helpful to understand the overall manufacturing process of which etching is a part.

Figure 1:
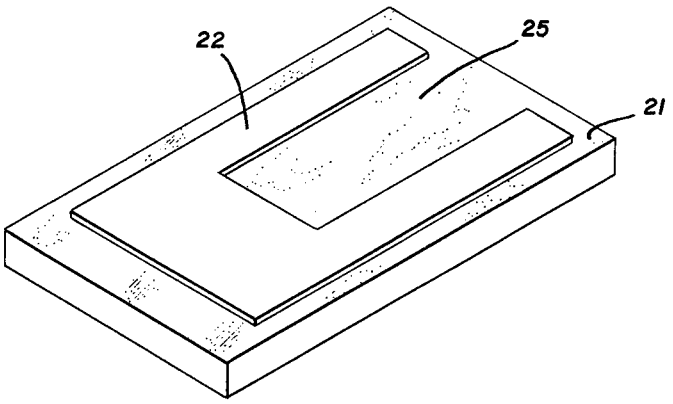
FIG. 1 is an isometric view of a glass substrate with a metallic conductive path thereon.

Referring first to FIG. 1, there is illustrated a glass substrate 21 with a metallic conductive path 22 thereon. The path can be any of several commonly used metals. Considerations involved when selecting the metal include an analysis of the metal's bonding ability with respect to the type of semiconductor device to be affixed thereto and to glass, the possibility of oxidation or corrosion, the metal's conductivity, etc.

Figure 2:
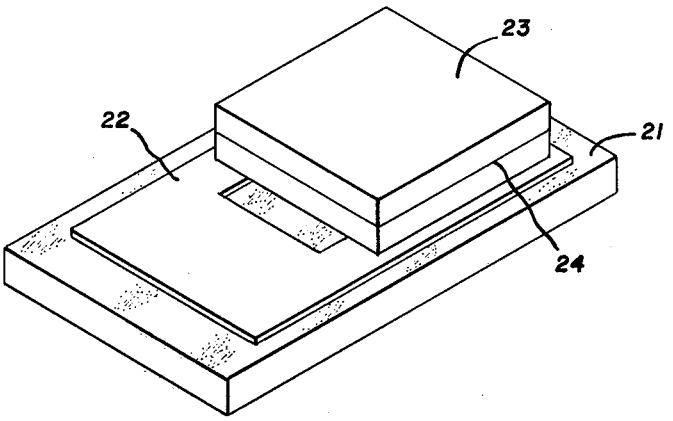
FIG. 2 is an isometric view of the substrate depicted in FIG. 1 with a semiconductor pellet bonded thereto.

Referring now to FIG. 2, there is shown the glass substrate 21 with the conductive path 22 thereon and a semiconductor device pellet 23 bonded to the metal. The pellet can be, for example a light emitting diode with a single PN junction 24. It is sometimes beneficial to mount a light emitting diode 24 so that light is emitted from the lower surface and is transmitted by the glass substrate 21. To so mount a device two constraints must be met. First, there must be optical coupling between the pellet 24 and the glass 21. Thus, an open area 25 in the metallic conductor 22 must be formed. Secondly, efficient electrical coupling must be made to the surface of the pellet adjacent the glass 21. Thus, the function of the metallic conductive path 22 will be appreciated. It will also be appreciated that optimum optical coupling is obtained only if the glass substrate in the region of the open area 25 is free of haziness and pitting.

A more detailed description of a method for the fabrication of such a semiconductor pellet-glass mounting system can be obtained from a U.S. Pat. No. 3,893,229 in the name of A. D. Aird, filed Oct. 29, 1973 and assigned to the assignee of the present invention.

The metallized glass as illustrated in FIG. 1 is generally manufactured as one of a plurality of such glass portions on a wafer or disc of glass. However, it need not be manufactured in wafer form and for purposes of this invention it is unimportant whether the glass substrates 21 are treated individually or in wafer form.

During manufacture of the device depicted in FIG. 1 the first step is to coat the glass substrate 21 with the metal to be used. The metal system featured in the aforementioned Aird application is a layer of titanium surmounted by a layer of gold that is in turn covered with germanium. If that metallization system is used as an example, it will be appreciated that the titanium etching step is particularly difficult inasmuch as it is the titanium that is adjacent the glass. Using the aforementioned germanium, gold and titanium metallization system as an example, the initial step involved in fabricating the metallized substrate shown in FIG. 1 is to deposit a layer of titanium on a clean body of glass. Following the deposition of the titanium, the layers of gold and germanium are deposited. Next, the pattern for the metallic conductor 22 is outlined by photoresist techniques. The deposition and photoresist masking steps are conventional processes.

Following masking, the gold and germanium can be etched by conventional methods. For example, a cyanide combined with reducing agent, such as hydrogen peroxide, will effectively etch the gold.

After the gold and germanium have been removed from all areas except those masked, the titanium must be etched without attacking the glass substrate.

The preferred etchant for the titanium is as follows:

| | | |
|---|---|---|
| Hydrofluoric Acid | (50% assay) | 1% |
| Nitric Acid | (70.5% assay) | 20% |
| Acetic Acid | | 54% |
| Lactic Acid | (85% assay) | 25% |

To remove 500 Angstroms of titanium with the aforementioned etchant requires approximately thirty seconds.

The aforementioned etchant acts as follows. The hydrofluoric acid and nitric acid perform an oxidation reduction etching process on the titanium. Only a small amount of hydrofluoric acid is used to assure an acceptably low etching rate.

The acetic acid functions as a substantially non-ionizing diluent for the hydrofluoric and nitric acids. Water should not be used as a diluent inasmuch as it will ionize the nitric acid and thus accentuate the etching action.

Finally, the lactic acid acts as a protective liquid coating agent that wets the glass where it is exposed and thus prevents the etching thereof. Several considerations are involved in choosing a protective coating agent. For example, high viscosity is desirable inasmuch as any turbulence generated during the etching operation will have a tendency to remove the protective coating agent. A more viscous agent more effectively resists the effects of turbulence. Furthermore, the protective coating agent should not adversely react with the oxidation or reduction agents. It has been found that lactic acid meets all these criteria well. An additional advantage obtained from the use of a viscous protective coating agent is that it tends to collect and remain under any over-hanging photoresist and thus prevent excessive undercutting.

During very long etching processes, there may be a measurable attack of the glass. However, it has been found that the etching of the glass is extremely slow and uniform. Thus, even after an exposure of 24 hours, glass is still transparent and smooth, rather than pitted and hazy.

Following the aforementioned titanium etching process, device construction can proceed according to the method disclosed by Aird or by any other desired technique.

It will be appreciated that the aforementioned composition for etching titanium is but one form of the invention. For example, the same techniques can be used to etch silicon, copper, silver, iron, nickel, or many other metals. What is required is that an acceptable oxidizing agent and an acceptible reducing agent be selected for the desired metal. Such oxidizing and reducing agents are well known in the art for various metals. Further, the aforementioned considerations must be recalled when a protective coating agent is selected. Finally, if sufficient control over the etching rate cannot otherwise be obtained, a nonionizing diluent can be employed.

Even when etching titanium many substitutions are possible. The following list is indicative of the many combinations of materials that can effectively be combined to form an etchant for titanium.

For nitric acid, the following substitutes are available: Chromic acid and hydrogen peroxide.

For acetic acid, formic acid can be used.

If desired, lactic acid can be replaced by diethylene glycol or polyethylene glycol, however shelf life of the solution may then be impaired.

In an effort to determine permissible ranges for the various constituents, the following solutions were evaluated. "Time" refers to the time in seconds needed to remove approximately 500 Angstroms of titanium. Quantities are expressed in volume (milliliters).

| Hydro-fluoric | Nitric | Acetic | Lactic | Total | Time |
|---|---|---|---|---|---|
| .2 | 20 | 54 | 25 | 99.2 | 600 |
| .3 | 20 | 54 | 25 | 99.3 | 300 |
| .4 | 20 | 54 | 25 | 99.4 | 150 |
| .6 | 20 | 54 | 25 | 99.6 | 30 |
| 1 | 20 | 54 | 25 | 100 | 15 |
| 1 | 20 | 54 | 25 | 100 | 30 |
| 2 | 20 | 54 | 25 | 101 | 15 |
| 3 | 20 | 54 | 25 | 102 | 5 |
| 4 | 20 | 54 | 25 | 103 | 2 |
| 5 | 20 | 54 | 25 | 104 | 1 |
| 1 | 10 | 54 | 25 | 90 | 60 |
| 1 | 20 | 54 | 25 | 100 | 55 |
| 1 | 30 | 54 | 25 | 110 | 35 |
| 1 | 40 | 54 | 25 | 120 | 30 |
| 1 | 50 | 54 | 25 | 130 | 25 |
| 1 | 60 | 54 | 25 | 140 | 10 |
| 1 | 20 | 54 | 15–60 | 90–145 | 10 |
| 1 | 20 | 30–65 | 25 | 76–111 | 20 |

The last two lines represent a group of solutions that were shown substantially independent of lactic and acetic acid concentrations.

Each of the lines except the last two represents a separate solution on a separate sample. It will be observed that the preferred solution (1% hydrofluoric, 20% nitric, 54% acetic, 25% lactic) occurs three times in the chart, with different etch times for each occurrence. This is attributed to an inability to precisely determine when etching terminates and other variables and is not deemed important. Optimum etch time in a manufacturing process can be selected by experimentation. There need be no fear of selecting too long of a time in an effort to assure complete etching inasmuch as the lactic acid protects the glass from attack. The above chart does indicate the wide range of constituent proportion that still provide effective etchants.

Consequently, it will be appreciated that many modifications and variations of the present invention will be apparent to those skilled in the art. It is desired, therefore, that the invention be limited in scope only by the claims appended hereto.

What is claimed is:

1. An etchant for removing metal from a glass substrate comprising:

hydrofluoric acid for oxidizing said metal to form a metal oxide;

nitric acid for reducing said metal oxide; and lactic acid for protectively coating said glass substrate and inhibiting attack thereof by said hydrofluoric acid and nitric acid.

2. An etchant according to claim 1 further comprising acetic acid for diluting said hydrofluoric acid and nitric acid.

3. An etchant for removing metal from a glass substrate, said etchant comprising essentially, in volume percent:

| | | |
|---|---|---|
| Hydrofluoric Acid | (50% assay) | 0.1–5% |
| Nitric Acid | (70.5% assay) | 10–60% |
| Acetic Acid | | 30–65% |
| Lactic Acid | (85% assay) | 15–60%. |

4. An etchant for removing titanium from a glass substrate, said etchant comprising essentially, in volume percent:

| | | |
|---|---|---|
| Hydrofluoric Acid | (50% assay) | 1% |
| Nitric Acid | (70.5% assay) | 20% |
| Acetic Acid | | 54% |
| Lactic Acid | (85% assay) | 25%. |

* * * * *